US010931042B2

(12) United States Patent
Villard et al.

(10) Patent No.: US 10,931,042 B2
(45) **Date of Patent: *Feb. 23, 2021**

(54) ELECTRICAL CONNECTION SYSTEM WITH TWO CONNECTION BRANCHES

(71) Applicant: TE CONNECTIVITY SERVICES GMBH, Schaffhausen (CH)

(72) Inventors: Romain Villard, Tassin la Demi Lune (FR); Yannick Villardier, Mions (FR)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/337,237

(22) PCT Filed: Sep. 29, 2016

(86) PCT No.: PCT/EP2016/073298

§ 371 (c)(1),
(2) Date: Mar. 27, 2019

(87) PCT Pub. No.: WO2018/059695

PCT Pub. Date: Apr. 5, 2018

(65) Prior Publication Data

US 2019/0305448 A1 Oct. 3, 2019

(51) Int. Cl.
*H01R 4/24* (2018.01)
*H01R 11/05* (2006.01)
(Continued)

(52) U.S. Cl.
CPC ..... *H01R 11/05* (2013.01); *H01R 4/4827* (2013.01); *H01R 9/2691* (2013.01); *H01R 13/113* (2013.01); *H01R 13/18* (2013.01)

(58) Field of Classification Search
CPC ..... H01R 4/4818
(Continued)

(56) References Cited

U.S. PATENT DOCUMENTS 5,022,873 A 6/1991 Kollmann
5,890,916 A 4/1999 Diekmann et al.
(Continued)

FOREIGN PATENT DOCUMENTS

CN 102593616 A 7/2012
DE 20120811 U1 4/2003
(Continued)

OTHER PUBLICATIONS

English Machine Translation Abstract of CN102593616.
(Continued)

*Primary Examiner* — Phuong K Dinh
(74) *Attorney, Agent, or Firm* — Cantor Colburn LLP

(57) ABSTRACT

The invention relates to an electrical connection system for an electrical appliance, such as a terminal block (7), the electrical connection system (7) comprising a conductive strip (21) comprising two connecting branches (63*a*, 63*b*) arranged so as to cooperate with a conductive portion (13') of an electrical conductor (13) in a connecting position and having a cooperating area (35) arranged so as to cooperate with a portion (15') of a support rail (15) in a cooperating position, a leaf spring (23), and a holding device (49) arranged so as to hold the portion (15') of the support rail (15) in contact between the two cooperating branches (63*a*, 63*b*) in the cooperating position, at least one connecting branch (63*a*, 63*b*) having a cross-opening (69*a*, 96*b*) designed so that a portion of the holding device (49) passes therethrough in the cooperating position.

20 Claims, 5 Drawing Sheets

(51) Int. Cl.

| | |
|---|---|
| ***H01R 4/48*** | (2006.01) |
| ***H01R 9/26*** | (2006.01) |
| ***H01R 13/11*** | (2006.01) |
| ***H01R 13/18*** | (2006.01) |

(58) Field of Classification Search
USPC ..... 439/441, 835, 834
See application file for complete search history.

(56) References Cited

U.S. PATENT DOCUMENTS

| | | | |
|---|---|---|---|
| 7,686,626 | B2 | 3/2010 | Wu et al. |
| 7,922,521 | B1 | 4/2011 | Wu |
| 7,927,132 | B1 | 4/2011 | Lin |
| 2001/0051466 | A1 | 12/2001 | Bechaz et al. |
| 2005/0079773 | A1 | 4/2005 | Prokup et al. |
| 2005/0085107 | A1 | 4/2005 | Hackemack et al. |
| 2006/0063419 | A1 | 3/2006 | Steinkemper et al. |
| 2008/0102715 | A1 | 5/2008 | Coffy |
| 2008/0233782 | A1 | 9/2008 | Hoppmann |
| 2009/0035998 | A1 | 2/2009 | Schrader |
| 2010/0173531 | A1 | 7/2010 | Holste |
| 2013/0133716 | A1 | 5/2013 | Buettner |
| 2016/0248174 | A1 | 8/2016 | Ludewig et al. |
| 2016/0314911 | A1 | 10/2016 | Knoerrchen et al. |
| 2017/0025805 | A1 | 1/2017 | Pizzi |
| 2019/0229440 | A1 | 7/2019 | Villard et al. |
| 2019/0296460 | A1* | 9/2019 | Villard ..... H01R 25/142 |

FOREIGN PATENT DOCUMENTS

| | | | |
|---|---|---|---|
| DE | 20305313 | U1 | 8/2004 |
| DE | 102004045026 | | 2/2006 |
| FR | 2844105 | A1 | 3/2004 |
| WO | 2004021521 | A1 | 3/2004 |

OTHER PUBLICATIONS

International Search Report for Application No. PCT/EP2016/073300.
Written Opinion for Application No. PCT/EP2016/073300.
English Machine Translatiopn of Abstract DE102004045026.
International Search Report for Application No. PCT/EP2016/073297.
Written Opinion for Application No. PCT/EP2016/073297.
U.S. Office Action for U.S. Appl. No. 16/337,212; dated Jan. 22, 2020.
U.S. Office Action for U.S. Appl. No. 16/337,199; dated Sep. 26, 2019.
U.S. Office Action for U.S. Appl. No. 16/337,199; dated Apr. 9, 2020.
U.S. Notice of Allowance for U.S. Appl. No. 16/337,199; dated Jul. 8, 2020.
U.S. Office Action for U.S. Appl. No. 16/337,212; dated Jun. 4, 2020.
English Machine Translation to DE20305313 Abstract.
Written Opinion for Application No. PCT/EP2016/073298.
International Search Report for Application No. PCT/EP2016/073298.

* cited by examiner

ELECTRICAL CONNECTION SYSTEM WITH TWO CONNECTION BRANCHES

CROSS REFERENCE TO RELATED APPLICATIONS

This application is a National Stage of PCT Application No. PCT/EP2016/073298 filed on Sep. 29, 2016, the contents of which are incorporated herein by reference thereto.

TECHNICAL FIELD

The present invention concerns an electrical connection system for an electrical apparatus such as a junction block, the system comprising two branches for connection with a portion of a support rail.

BACKGROUND

It is known to use a junction block comprising an electrical connection system allowing electrically connecting an electrical conductor and a support rail.

This electrical connection system comprises a conductive strip which is arranged to be electrically connected to both the electrical conductor and the support rail.

It is possible to provide a device for maintaining cooperation between the support rail and this conductive strip.

The maintenance of the cooperation may be difficult because the holding device requires the reduction of the section of the conductive strip for its installation.

The current may thus be less well transmitted at the level of this reduced section.

BRIEF SUMMARY

The present invention aims at solving all or part of the above-mentioned drawbacks.

To this end, the present invention concerns an electrical connection system for an electrical apparatus such as a junction block, the electrical connection system comprising:

- a conductive strip comprising two connection branches arranged to cooperate with a conductive portion of an electrical conductor in a connection position and having a cooperation area arranged to cooperate with a portion of a support rail in a cooperation position,
- a clamping device arranged to hold the conductive portion in the connection position, such as a leaf spring comprising a bearing branch arranged to be mounted to the conductive strip and a clamping branch arranged to hold the conductive portion in the connection position.
- a holding device arranged to hold the portion of the support rail in contact between the two connection branches in the cooperation position, at least one connection branch has a through opening configured for the passage of a portion of the holding device in the cooperation position.

In other words, the holding device is partially formed in the conductive strip.

The fact of disposing a through opening in the connection branch(es) results in creating two passage channels for the current bypassing the through opening.

Hence, this arrangement allows not having a weakened area in which the transmission of current is reduced at the level of the through opening.

Indeed, unlike the conductive strips having a lateral notch for the arrangement of the holding device, the fact of disposing two passage channels improves the current flow.

According to another aspect of the invention, the clamping device is a device equivalent to the leaf spring, this device being arranged to hold the conductive portion in the connection position with the conductive strip.

According to this other aspect of the invention, the clamping device is a screw clamping device.

According to an aspect of the invention, said through opening corresponds to a reduction comprised between 10% and 50% of a nominal section over a defined length of said at least one corresponding connection branch.

The nominal section is a section of said at least one corresponding connection branch remote from the through opening.

Preferably, the reduction is comprised between 10% and 40% and in particular between 15% and 30%.

This arrangement quantifies the acceptable section reduction for the current to be properly transmitted despite the through opening.

According to an aspect of the invention, each connection branch has a through opening configured for the passage of a portion of the holding device in the cooperation position.

This arrangement allows an improvement in the current flow, the current passage section comprising four passage channels.

According to an aspect of the invention, a first connection branch comprises a first through opening and a second connection branch comprises a second through opening, the first through opening facing the second through opening.

This arrangement allows easy insertion of the holding device into the conductive strip to position it in the cooperation position.

According to an aspect of the invention, the first through opening and the second through opening are symmetrical with respect to a central plane.

This symmetry enables a good positional holding of the portion of the support rail because the clamping forces are evenly distributed.

This arrangement also facilitates the installation of the holding device: there is no risk of blockage of the holding device during its installation in the cooperation position.

According to an aspect of the invention, each connection branch has a cooperation extension arranged to cooperate with the portion of the support rail in the cooperation position.

This arrangement enables an effective clamping of the portion of the support rail in the cooperation position and also ensuring good electrical contact.

According to an aspect of the invention, the cooperation extensions of the connection branches extend along the same axis in the cooperation position.

This arrangement improves the cooperation between the connection branches and the conductive strip in the cooperation position.

According to an aspect of the invention, at least one connection branch further has a cooperation stop extending transversely to the cooperation extension.

This arrangement enables a good holding in the cooperation position of the portion of the support rail.

Indeed, in the cooperation position, the portion of the support rail comprises a first portion complementary with the cooperation extension extending in a first plane and comprises a second portion complementary with the cooperation stop extending in a second plane transversal to the first plane.

This cooperation in two transverse portions enables a good respective positioning of the support rail and of the electrical connection system in the cooperation position.

The risk of inadvertent movement in the cooperation position and therefore of interruption of electrical contact between the support rail and the conductive strip are thus limited.

According to an aspect of the invention, the cooperation stop is obtained from the folding of an end portion of the corresponding branch.

According to an aspect of the invention, the holding device comprises a clamping spring provided with two ends facing each other, each end being arranged to cooperate with a clamping location of a corresponding connection branch.

This arrangement allows holding the connection branches in the cooperation position reliably.

According to an aspect of the invention, at least one clamping location is formed in a cavity of the corresponding connection branch, said location being arranged to receive a corresponding end of the clamping spring.

This arrangement enables a simple set-up of the clamping spring on the connection branches. The ends of the clamping spring are thus held in the cavities. There is no risk of displacement of the clamping spring relative to the connection branches.

According to an aspect of the invention, each connection branch comprises a cavity as described hereinbefore.

According to an aspect of the invention, for each connection branch, the cavity and the cooperation extension are aligned in a direction transverse to the direction of extension of the corresponding branch.

This arrangement enables an optimal application of the clamping force of the clamping spring at the level of the cooperation extensions, which implies a good positional holding of the portion of the clamping rail in the cooperation position.

According to an aspect of the invention, each cooperation branch corresponds to a folded blade portion generating the cavity and the cooperation extension. This arrangement enables a simple and inexpensive manufacture of the conductive strip.

Also, the cavity has a furrow-like shape which allows disposing easily each end of the clamping spring in the corresponding clamping location laterally with respect to the direction of extension of the corresponding branch.

According to an aspect of the invention, the clamping spring has a C-shape.

This arrangement enables easy insertion of the clamping spring in the through openings.

According to an aspect of the invention, the conductive strip has a passage opening for insertion of the conductive portion in the connection position.

This arrangement allows making the conductive strip in one-piece having no weakened points because the current can still be transmitted in sufficient quantities by the two lateral branches generated by the passage opening.

According to an aspect of the invention, the conductive strip comprises a first portion and a second portion, the first portion facing the second portion.

This arrangement allows making a compact electrical connection system. This arrangement further allows adapting the position of the leaf spring according to the geometrical constraints due to the shape of the junction block.

According to an aspect of the invention, the first portion comprises the first connection branch and the second portion comprises the second connection branch.

According to an aspect of the invention, the conductive strip has a U-like general shape.

This arrangement allows making the conductive strip from a rectilinear blade which is then folded. This arrangement enables a saving of material because a base sheet metal cut into rectilinear blades causes little falls, that is to say little loss of material.

According to an aspect of the invention, the conductive strip is constituted by a folded conductive blade.

The manufacture of the conductive strip is easy since it is made from a cut sheet metal which is then folded to give the conductive strip its final shape.

According to an aspect of the invention, the conductive strip is constituted by a conductive blade.

This arrangement facilitates the manufacture of the conductive strip because it originates from a flat blade which is then transformed. The mass manufacture of this single conductive part thus allows saving production time and reducing the transformation costs in comparison with a system comprising several conductive parts.

Also, a saving of material is achieved because a base sheet metal can generate a large number of blades, material falls being reduced.

According to an aspect of the invention, the conductive blade is comprised within a rectangular contour.

Indeed, since the blade is a rectangle, it is easy to find an arrangement of the cutouts to be made on the base sheet metal so as to minimize falls and produce as many conductive strips as possible.

According to an aspect of the invention, the conductive strip comprises a depression adapted for the forced fitting of a fastening portion of the bearing branch.

This arrangement enables a simple and reliable fastening of the leaf spring on the conductive strip. The manufacture of the electrical connection system is thus simplified.

According to an aspect of the invention, the depression is achieved by cutting the conductive blade. The depression is thus achieved during the cutting of the conductive blade, which limits the manufacturing time.

Preferably, the cutout generates a through opening in the conductive strip.

The present invention also concerns a junction block comprising an insulating body in which is formed an electrical connection system as previously described.

According to an aspect of the invention, the insulating body comprises a support portion of the bearing branch.

This arrangement allows ensuring the blocking of the bearing branch when the clamping branch is urged.

According to an aspect of the invention, the insulating body comprises a support stud arranged to cooperate with the conductive strip so as to authorize the displacement of at least one connection branch relative to a corresponding fixed base of said branch contiguous to said connection branch.

This support stud therefore enables the positional holding of the conductive strip inside the junction block while authorizing the displacement of one branch or of both branches depending on its configuration.

According to an aspect of the invention, the support stud is arranged to cooperate with a first fixed base of the first connection branch and a second fixed base of the second connection branch.

According to an aspect of the invention, the insulating body comprises a centering wall arranged to hold in position the holding device in the cooperation position.

Anyway the invention will be better understood from the following description made with reference to the appended schematic drawings representing, as a non-limiting example, an embodiment of this electrical connection system.

DETAILED DESCRIPTION

Figure 1:
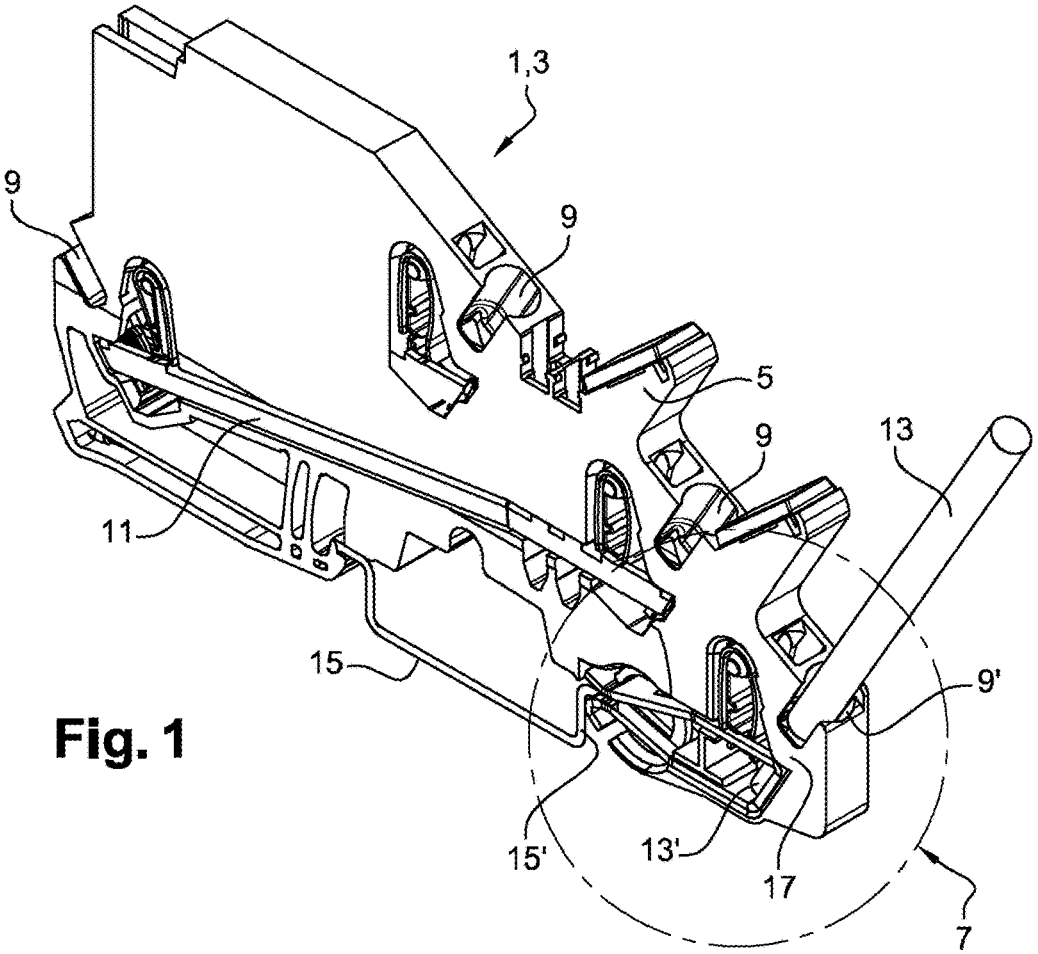
FIG. 1 is a perspective view of a junction block, an electrical conductor and a support rail.
Figure 2:
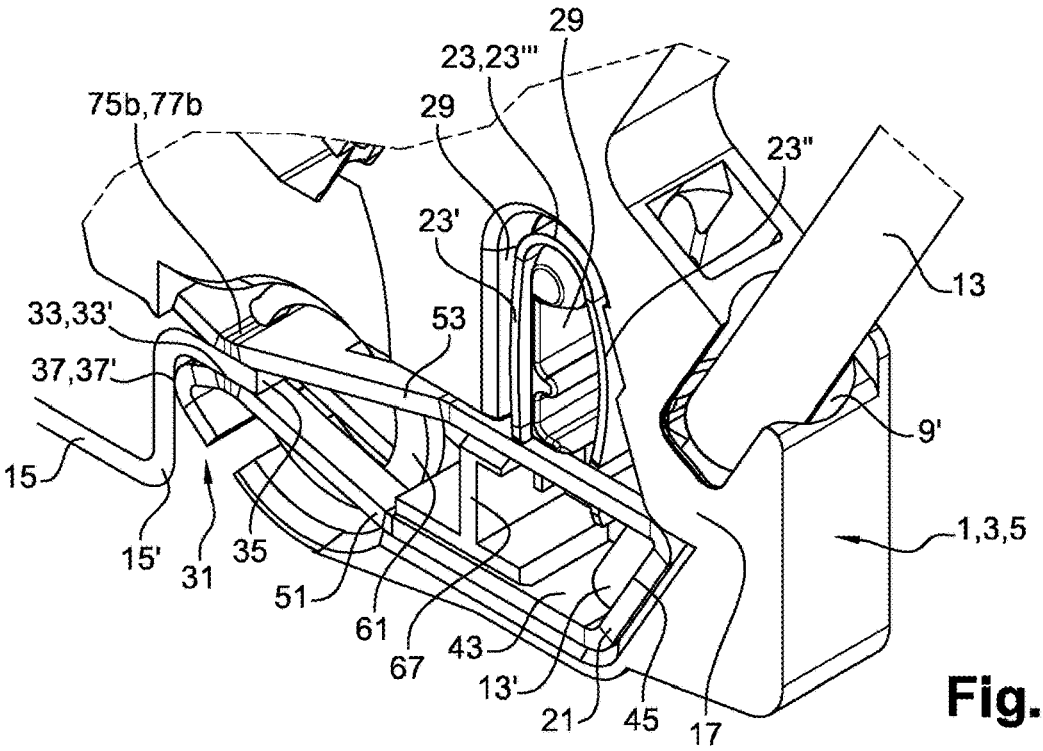
FIG. 2 is a detail view of FIG. 1.
Figure 3:
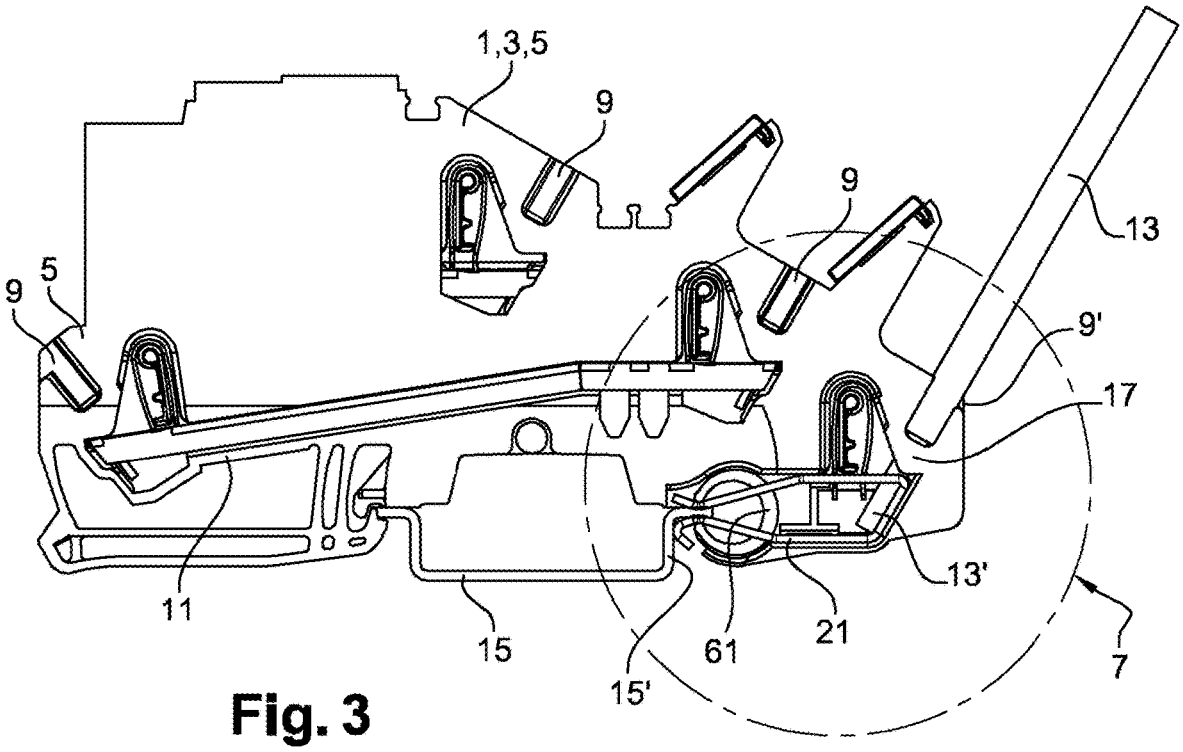
FIG. 3 is a perspective view of the junction block, the electrical conductor and the support rail.
Figure 4:
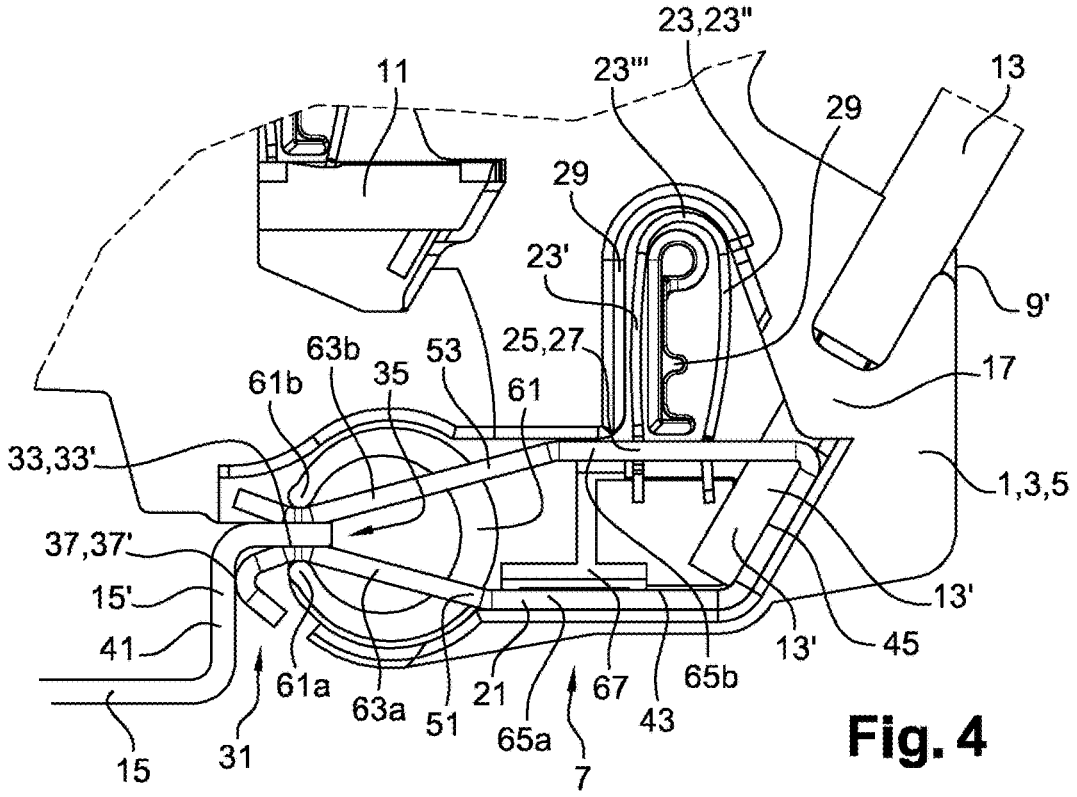
FIG. 4 is a detail view of FIG. 3.
Figure 5:
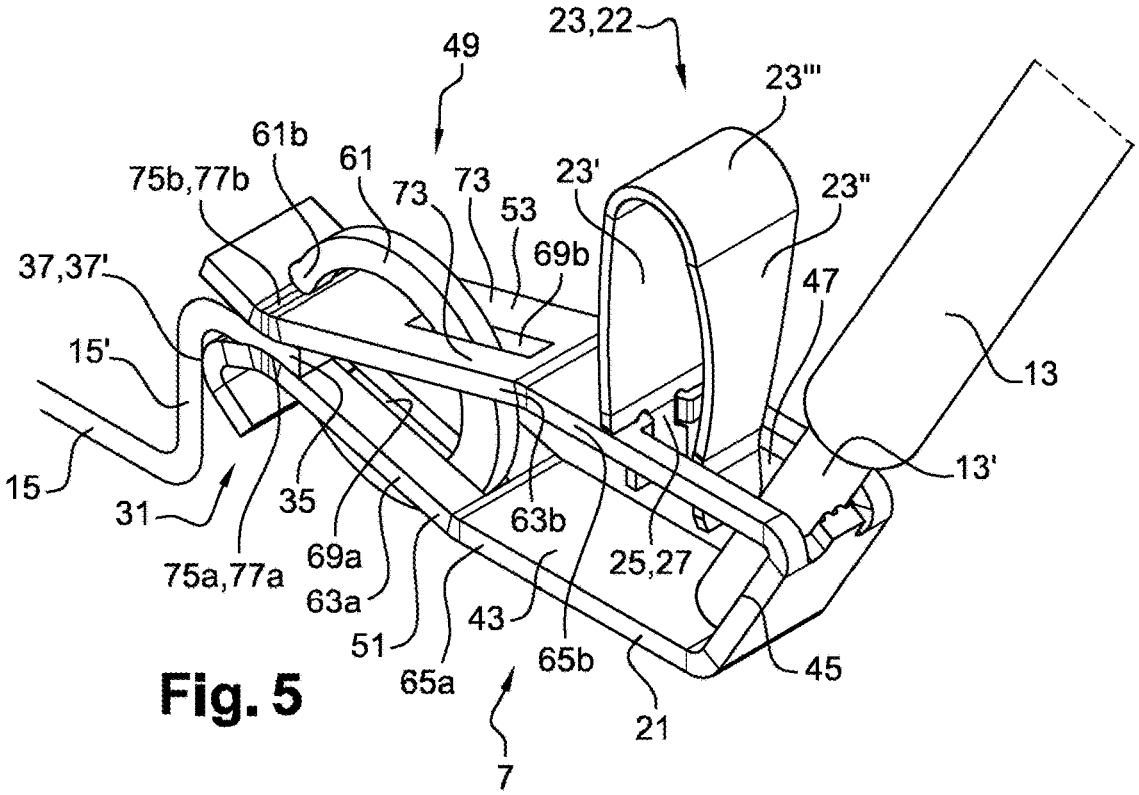
FIG. 5 is a perspective view of an electrical connection system, the electrical conductor and the support rail.
Figure 6:
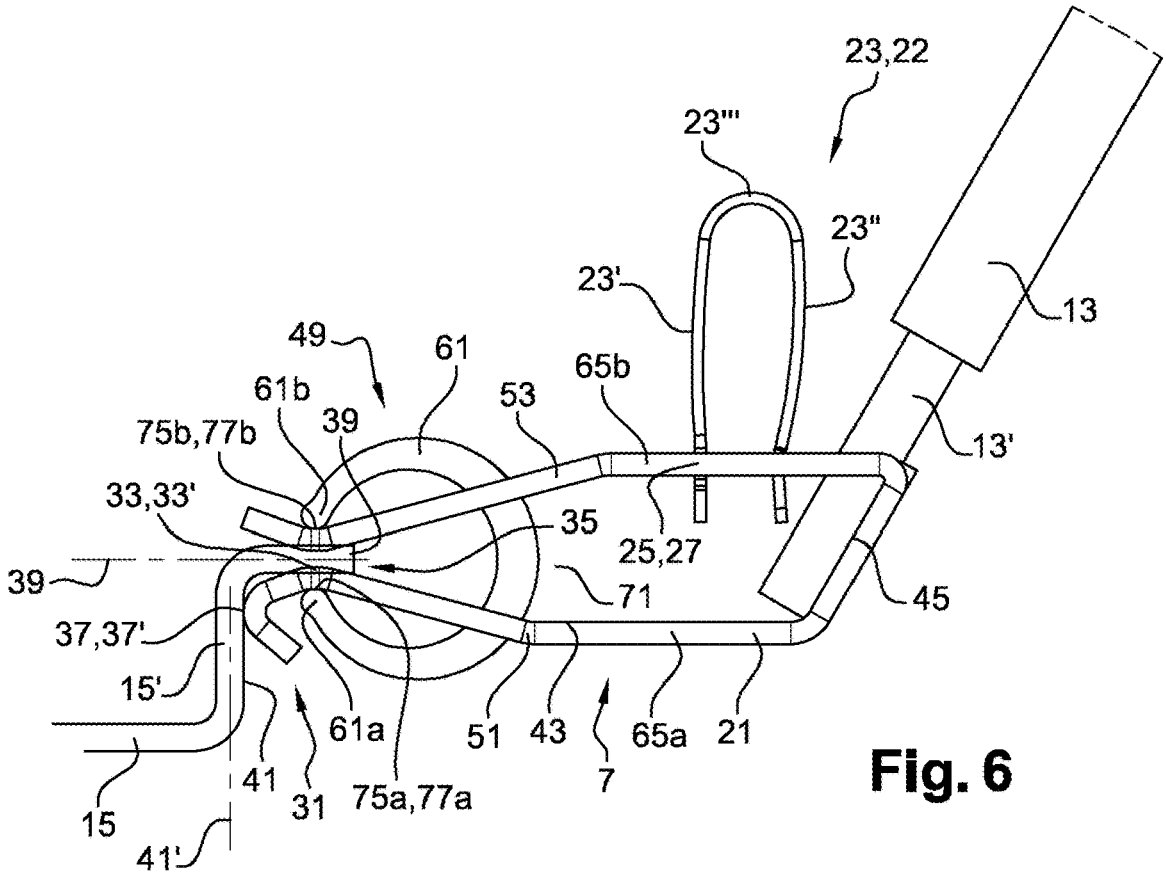
FIG. 6 is a front view of the electrical connection system, the electrical conductor and the support rail.
Figure 7:
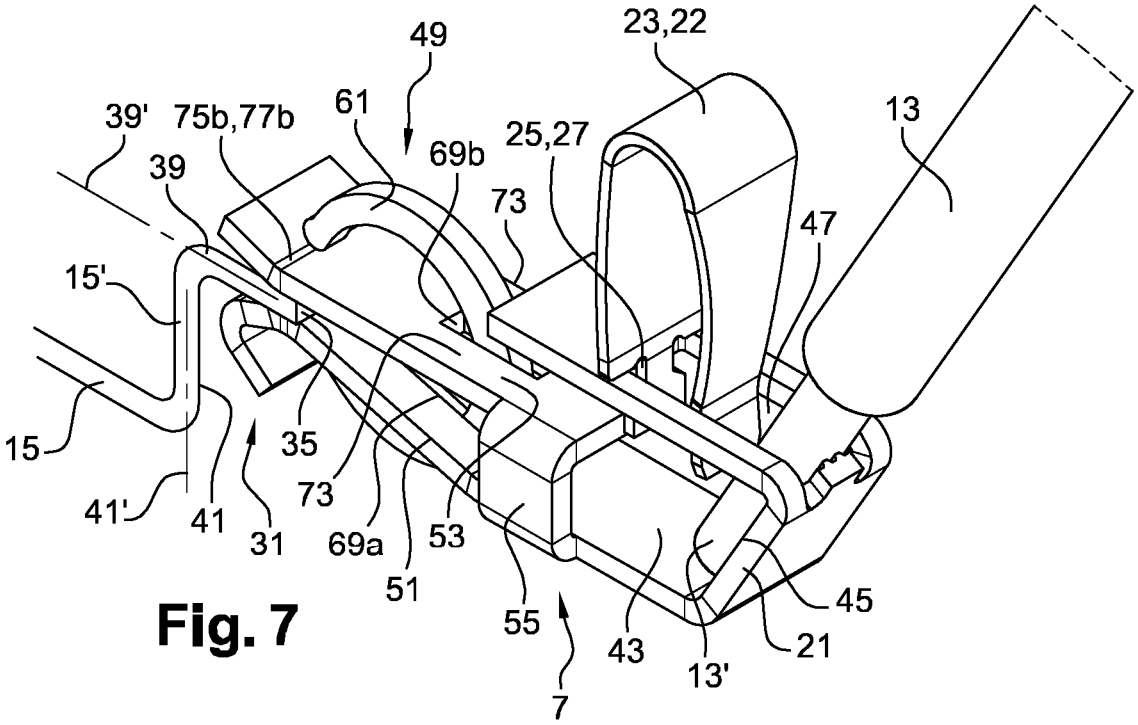
FIG. 7 is a perspective view of a variant of the electrical connection system, the electrical conductor and the support rail.
Figure 8:
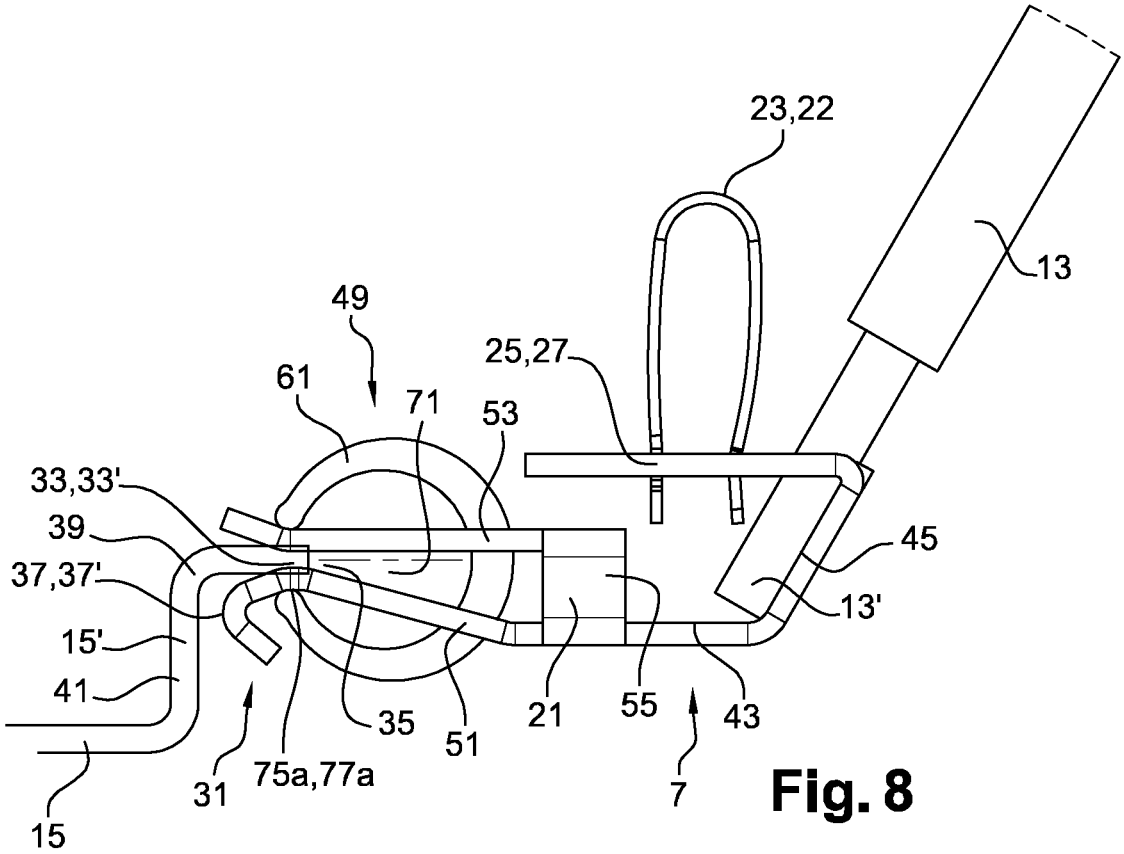
FIG. 8 is a front view of the variant of the electrical connection system, the electrical conductor and the support rail.
Figure 9:
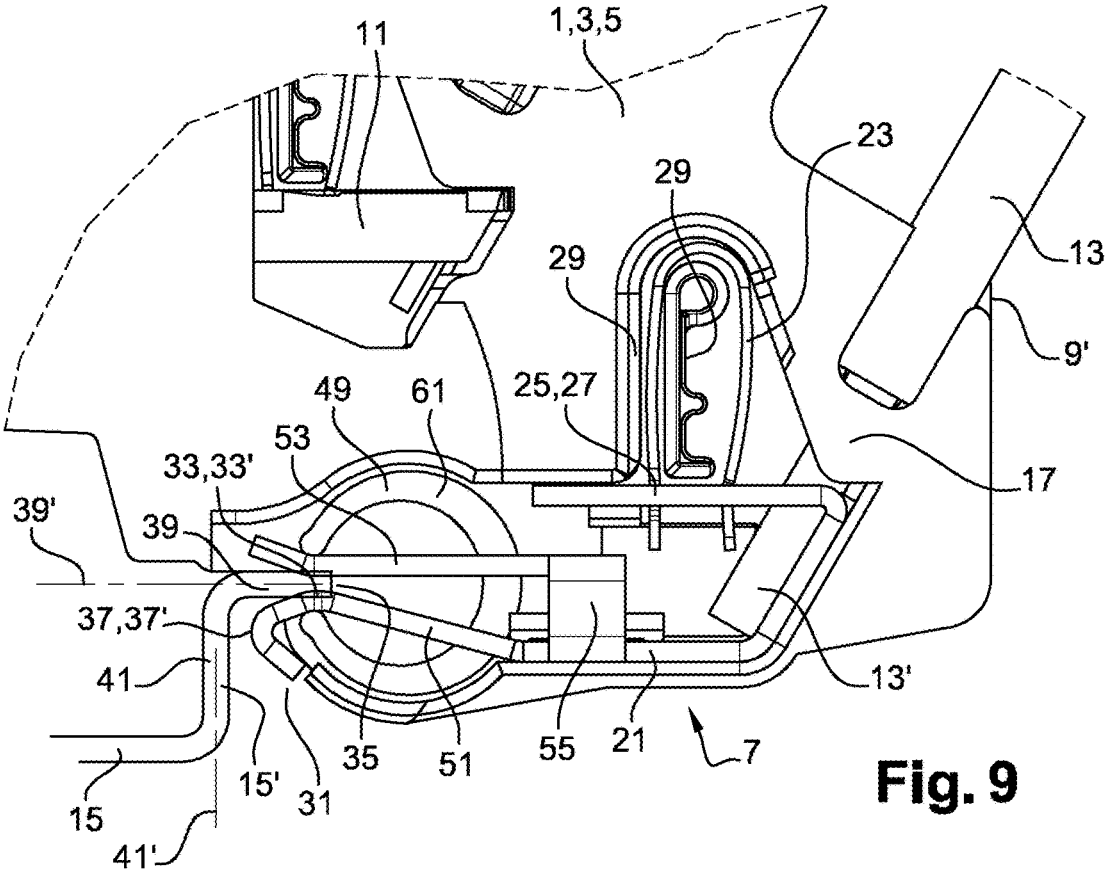
FIG. 9 is a front view of the junction block according to the variant.
Figure 10:
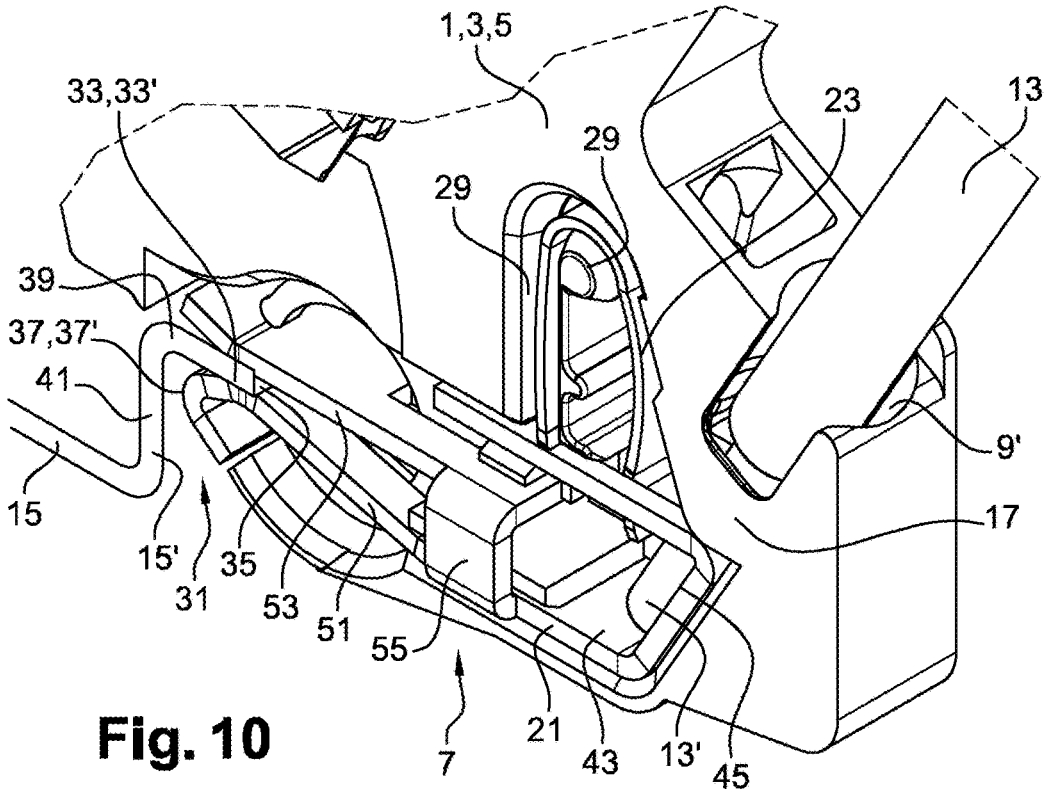
FIG. 10 is a detail view of FIG. 9.

As illustrated in FIGS. 1 to 10, an electrical apparatus 1 such as a junction block 3 comprises an insulating body 5 and an electrical connection system 7, the electrical connection system 7 being formed in the insulating body 5.

The junction block 3 comprises sockets 9 for electrical conductors. Two sockets 9 are linked by a linking bar 11 so as to establish an electrical contact between two corresponding conductors.

The junction block 3 also has a socket 9' for an electrical conductor 13 intended to be electrically connected to a support rail 15 on which the junction block 3 is removably fastened.

This electrical connection is established by the electrical connection system 9 as detailed hereinafter. The electrical conductor 13 has at one end a conductive portion 13' for example a metal tip.

The metal tip is arranged to be inserted into an insertion channel 17 of the socket 9' where it is held in position by the electrical connection system 7.

The socket 9' further comprises a maneuvering channel 19 in which a user can introduce a screwdriver-type tool for the withdrawal of the electrical conductor 13.

As illustrated in FIGS. 5 to 8, the electrical connection system 7 comprises a conductive strip 21 arranged to transmit a current between the conductive portion 13' of the electrical conductor 13 and a portion 15' of the support rail 15.

The support rail 15 thus has a dual function since it enables fastening of the junction block 3 and is also used to be electrically connected to the electrical conductor 16.

The electrical connection system 7 also comprises a clamping device 22 such as a leaf spring 23 arranged to hold the conductive portion 13' in a connection position with the conductive strip 21 as illustrated in FIGS. 5 to 8.

According to other non-detailed alternatives, any other type of clamping device 22 could be used provided that the clamping device 22 is arranged to hold the conductive portion 13' in a connection position with the conductive strip 21. A screw clamping device 22 could for example be used.

The leaf spring 23 comprises a bearing branch 23' arranged to be fastened to the conductive strip 21. For this purpose, the conductive strip 21 has a depression 25 or a through opening resulting from a cutout adapted for the forced fitting of a fastening portion 27 of the bearing branch 23'.

The leaf spring 23 also comprises a clamping branch 23" joined by a hinge 23'" to the bearing branch 23'. The clamping branch 23" is arranged to hold the conductive portion 13' in the connection position.

Indeed, the bearing branch 23' is fixed relative to the conductive strip 21 and the hinge 23'" imposes a constraint on the conductive portion 13' via the clamping branch 23".

The maneuvering channel 19 is disposed so as to enable the displacement of the clamping branch 23" for the withdrawal of the electrical conductor 13.

The insulating body 5 has a support portion 29 of the bearing branch 23' whose function is to block the bearing branch 23' during the displacement of the clamping branch 23".

The conductive strip 21 has a folded end portion 31 generating a first portion 33' of a cooperation area 35 or a cooperation extension 33 and a second portion 37' of the cooperation area 35 or cooperation stop 37.

This first portion 33' of the conductive strip 21 is arranged to cooperate with a first complementary portion 39 of the support rail 15 extending in a first plane 39'.

This second portion 37' of the conductive strip 21 is arranged to cooperate with a second complementary portion 41 of the support rail 15 extending in a second plane 41' transverse to the first plane 39'.

The conductive strip 21 also has a longitudinal contact surface 43 on which are formed an electrical contact location 45 with the conductive portion 13' in the connection position, the cooperation extension 33 and the cooperation stop 37.

The electrical contact location 45 extends rectilinearly according to a profile generating one or several slot(s) for a better holding of the conductive portion 13' in the connection position.

The conductive strip 21 further has a passage opening 47 for the insertion of the conductive portion 13' in the connection position. This passage opening 47 results for example from a cutout made before folding the conductive strip 21.

The electrical connection system 7 also comprises a holding device 49 arranged to hold the support rail 15 in a cooperation position with the conductive strip 21.

The cooperation is achieved by contact, which enables a current transmission between the conductive strip 21 and the support rail 15.

The conductive strip 21 comprises a first portion 51 and a second portion 53 at least partially facing the first portion 51.

The first portion 51 comprises the longitudinal contact surface 43 and the second portion 53 cooperates with the holding device 49. Disposing these two portions 51, 53 allows obtaining a compact electrical connection system 7 and/or adapting to geometrical constraints imposed to the junction block 3.

The conductive strip 21 can thus be obtained by a cutout in a base sheet metal and then by folding.

As illustrated in FIGS. 1 to 6, the conductive strip may have a U-like general shape. The first portion 51 and the second portion 53 are each formed in a different U branch.

The U-like general shape of the conductive strip 21 is obtained from a conductive blade cut from a base sheet metal. The blade is comprised in a rectangular contour which allows a saving of material by limiting the falls during cutting. During cutting, the through openings are also created.

Alternatively, it is possible as illustrated in FIGS. 7 to 10 to provide a conductive strip 21 before folding comprising several transverse portions linked to each other so as to generate a lateral connection 55 after folding.

This arrangement allows holding a large section for good current transmission once the conductive strip 21 is folded. Once folded, the conductive strip 21 also has good strength and is not likely to be deformed during mounting in the junction block 3.

As illustrated in FIGS. 1 to 10, the holding device 7 comprises a C-shaped clamping spring 61 comprising a first end 61*a* and a second end 61*b* facing the first end 61*a*.

Hence, the clamping spring 61 provides a clamping force between its two ends 61*a*, 61*b*. It is arranged to maintain the cooperation between the portion 15' of the support rail 15 and the conductive strip 21 in the cooperation position.

The conductive strip 21 comprises a first connection branch 63*a* and a second connection branch 63*b* respectively movable relative to a contiguous first fixed base 65*a* and a contiguous second fixed base 65*b* of the conductive strip 21.

A support stud 67 ensures the displacement of the connection branches 63*a*, 63*b* while holding the fixed bases 65*a*, 65*b* in position. Thus, the connection branches 63*a*, 63*b* operate like a jaw clasping the portion 15' of the support rail 15 in the cooperation position.

The first connection branch 61*a* has a first through opening 69*a* and the second connection branch 61*b* has a second through opening 69*b*.

The first through opening 69*a* and the second through opening 69*b* face each other and are symmetrical with respect to a central plane 71.

Each through opening 69*a*, 69*b* generates two current passage channels 73, which enables good current transmission in the conductive strip although material has been removed to form said opening.

Each connection branch 63*a*, 63*b* also has a cavity 75*a*, 75*b* in form of a furrow extending aligned with the corresponding cooperation extension 33 in a direction transverse to the central plane 71.

A clamping location 77*a*, 77*b* is formed in said cavity 75*a*, 75*b* of each connection branch 63*a*, 63*b*.

A first clamping location 77*a* is arranged to receive the first end 61*a* of the clamping spring 61 and a second clamping location 77*b* is arranged to receive the second end 61*b*.

Each connection branch 63*a*, 63*b* comprises a cooperation extension 33.

Since the clamping locations 77*a*, 77*b* and the cooperation extensions 33 are aligned transversely to the central plane 71, the clamping and the electrical contact are of good quality.

For a proper positioning of the clamping spring 61 during the introduction of the portion 15' of the clamping rail 15 in the cooperation position, the insulating body 5 has a centering wall 79.

During mounting the holding device 49, it is easy to introduce the clamping spring 61 by the through openings 96*a*, 69*b* then laterally pass the ends 61*a*, 61*b* of the clamping spring 61 in the cavities 75*a*, 75*b*.

The achieved clamping is also optimal because the clamping spring 61 is laterally centered with respect to the direction of extension of the conductive strip.

Hence, the described electrical connection system 7 features a simple constitution, an easy mounting enabling good current transmission.

It goes without saying that, the invention is not limited to the sole embodiment of this electrical connection system, described above as example, it encompasses on the contrary all variants thereof.

The invention claimed is:

1. An electrical connection system for a junction block, the electrical connection system comprising:

a conductive strip comprising two connection branches arranged to cooperate with a conductive portion of an electrical conductor in a connection position and having a cooperation area arranged to cooperate with a portion of a support rail in a cooperation position, a clamping device arranged to hold the conductive portion in the connection position, the clamping device being a leaf spring comprising a bearing branch arranged to be mounted to the conductive strip and a clamping branch arranged to hold the conductive portion in the connection position, a holding device arranged to hold the portion of the support rail in contact between the two connection branches in the cooperation position, and at least one connection branch of the two connection branches has a through opening configured for the passage of a portion of the holding device in the cooperation position.

2. The electrical connection system according to claim 1, wherein said through opening corresponds to a reduction comprised between 10% and 50% of a nominal section over a defined length of said at least one corresponding connection branch.

3. The electrical connection system according to claim 1, wherein each connection branch has a through opening configured for the passage of a portion of the holding device in the cooperation position.

4. The electrical connection system according to claim 3, wherein the two connection branches are a first connection branch having a first through opening and a second connection branch having a second through opening, the first through opening facing the second through opening.

5. The electrical connection system according to claim 1, wherein each connection branch has a cooperation extension arranged to cooperate with the portion of the support rail in the cooperation position.

6. The electrical connection system according to claim 5, wherein at least one connection branch further comprises a cooperation stop extending transversely to the cooperation extension.

7. The electrical connection system according to claim 5, wherein the cooperation extensions of the connection branches extend along the same axis in the cooperation position.

8. The electrical connection system according to claim 1, wherein the holding device comprises a clamping spring provided with two ends facing each other, each end being arranged to cooperate with a clamping location of a corresponding connection branch.

9. The electrical connection system according to claim 8, wherein at least one clamping location is formed in a cavity of the corresponding connection branch, said location being arranged to receive a corresponding end of the clamping spring.

10. The electrical connection system according to claim 8, wherein the clamping spring has a C-shape.

11. The electrical connection system according to claim 8, wherein the conductive strip has a passage opening for insertion of the conductive portion in the connection position.

12. The electrical connection system according to claim 1, wherein the conductive strip comprises a first portion and a second portion, the first portion facing the second portion.

13. The electrical connection system according to claim 12, wherein the conductive strip has a U-like general shape.

14. A junction block comprising an insulating body in which is formed an electrical connection system according to claim 1.

15. The junction block according to claim 14, wherein the insulating body comprises a support stud arranged to cooperate with the conductive strip so as to enable the displacement of at least one connection branch relative to a corresponding fixed base of said branch contiguous to said connection branch.

16. The electrical connection system according to claim 2, wherein each connection branch has a through opening configured for the passage of a portion of the holding device in the cooperation position.

17. The electrical connection system according to claim 16, wherein the two connection branches are a first connection branch having a first through opening and a second connection branch having a second through opening, the first through opening facing the second through opening.

18. The electrical connection system according to claim 17, wherein each connection branch has a cooperation extension arranged to cooperate with the portion of the support rail in the cooperation position.

19. The electrical connection system according to claim 18, wherein at least one connection branch further comprises a cooperation stop extending transversely to the cooperation extension.

20. The electrical connection system according to claim 19, wherein the cooperation extensions of the connection branches extend along the same axis in the cooperation position.

* * * * *